United States Patent [19]

Sandillon

[11] 4,372,140

[45] Feb. 8, 1983

[54] DEVICE FOR SHOT-BLASTING HOLLOW PARTS OF LARGE DIMENSIONS

[75] Inventor: Bernard Sandillon, Maurepas, France

[73] Assignee: Lutelec Luchaire Equipement, Montreuil, France

[21] Appl. No.: 166,915

[22] Filed: Jul. 8, 1980

[30] Foreign Application Priority Data

Jul. 9, 1979 [FR] France ..... 79 17754

[51] Int. Cl.[3] ..... B24C 1/10

[52] U.S. Cl. ..... 72/53

[58] Field of Search ..... 72/53, 40; 51/418, 438

[56] References Cited

U.S. PATENT DOCUMENTS

| | | | |
|---|---|---|---|
| 2,221,876 | 11/1940 | Mackin | 51/438 |
| 2,881,506 | 4/1959 | Fuchs | 72/53 |
| 2,933,802 | 4/1960 | Fuchs | 72/53 |
| 2,982,007 | 5/1961 | Fuchs | 72/53 |
| 3,426,563 | 2/1969 | Burney | 72/53 |
| 3,521,406 | 7/1970 | Carpenter | 72/53 |
| 3,523,391 | 3/1967 | Levinson | 51/411 |

FOREIGN PATENT DOCUMENTS

| | | |
|---|---|---|
| 1577550 | 1/1970 | Fed. Rep. of Germany . |
| 2121119 | 7/1972 | France . |
| 2127569 | 9/1972 | France . |
| 817711 | 8/1959 | United Kingdom . |

*Primary Examiner*—Gene Crosby

*Attorney, Agent, or Firm*—Wigman & Cohen

[57] ABSTRACT

An automatic shot-blasting device for containers, adapted more particularly for automatic sand-blasting and shot-blasting installations. The installation comprises a movable gantry for the shot-blasting of the sides and the roof, a shot-blasting panel for the end, and possibly an internal shot-blasting device. The air-shot mixture is transmitted by a switching device comprising two plates of which one is fixed and the other is movable in rotation and in translation. A step by step device causes the movable plate to rotate in order to bring the nozzles of the two plates into communication and permit the passage of the air-shot mixture therethrough.

10 Claims, 6 Drawing Figures

DEVICE FOR SHOT-BLASTING HOLLOW PARTS OF LARGE DIMENSIONS

BACKGROUND OF THE INVENTION

1. Field of the Invention

The invention relates to an automatic device for shot-blasting hollow parts of large dimensions, the device comprising a sealed enclosure, and displaceable oscillating shot-blasting ramps disposed in the enclosure.

2. Description of the Prior Art

The devices at present permit the shot-blasting of large area parts by means of ramps on which there are mounted blast pipes which, in certain embodiments, oscillate to permit the sweeping of a relatively large surface. Such devices are described, for example, in the U.S. Pat. Nos. 2,881,506 and 2,933,802. In the first patent cited, the part to be shot-blasted passes in front of a ramp carrying blast pipes to which a reciprocating movement is imparted in the vertical plane controlled by a simple jack acting on a rod. This device only permits the treatment of one face of a panel. In the second patent cited, the panel to be treated is placed on an inclined support and the shot-blasting ramp, surrounded by the sealed cabin, is displaced in front of the panel, the blast pipes effecting an oscillation movement in a vertical plane.

Other devices are known, for example from the German Pat. No. 1 577 550, enabling three faces of a part of relatively small dimensions such as I irons or H irons, to be treated, in which the blast pipes are placed in front of two opposite faces and rotate about the axis of the part to treat the other faces.

None of these devices permits treatment of a large part at at least four of its six sides as the case arises, for example, for containers intended for trucks or for railway cars. Generally, this container has the shape of a rectangular parallelepiped closed at the rear by doors and of which the floor, consisting of supporting beams, does not have to be subjected to shot-blasting. The use of the devices known at present permits a gain in time in comparison with the manual process but necessitates a large number of manipulations to treat the whole of the surface.

OBJECT AND SUMMARY OF THE INVENTION

The object of the invention is the treatment of the whole surface in a single operation which does not necessitate any manipulation of the part to be treated and which permits its execution in the minimum time, by the adoption of an automatic cycle obtained by the combination.

The automatic shot-blasting device according to the invention, comprising a sealed enclosure, displacement means for the part to be shot-blasted, shot-blasting ramps with movable oscillating blast pipes disposed in the enclosure is remarkable in that the enclosure comprises, at its ends, doors for the introduction and removal of the parts, and, at least at one of its ends, a shot-blasting panel, movable in a direction perpendicular to the longitudinal axis of the enclosure and retractable in a lateral recess in the enclosure, and, in the space comprised between said panel and the other end of the enclosure, a shot-blasting gantry, movable in the longitudinal axis of the enclosure, composed of three ramps forming an inverted U, which are disposed in a plane perpendicular to the axis of the enclosure, electrical means for synchronizing the movements of the gantry and of the panel, means for switching over the mixture of air and shot at least between the gantry and the panel, and means for controlling the movement of the oscillating blast pipes.

BRIEF DESCRIPTION OF THE DRAWINGS

The explanations and figures given below by way of example will enable it to be understood how the invention can be carried out.

DETAILED DESCRIPTION OF THE PREFERRED EMBODIMENT

Figure 1:
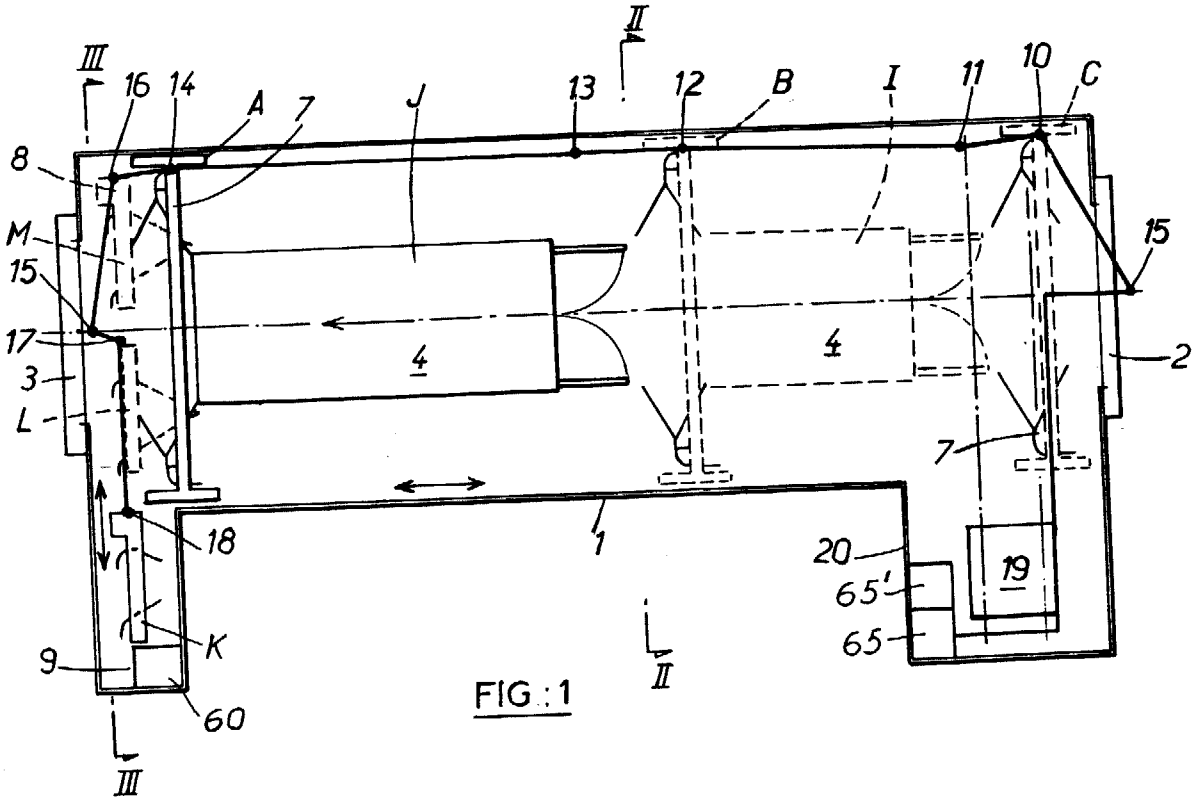
FIG. 1 is a diagrammatic plan view of the automatic installation according to the invention.
Figure 2:
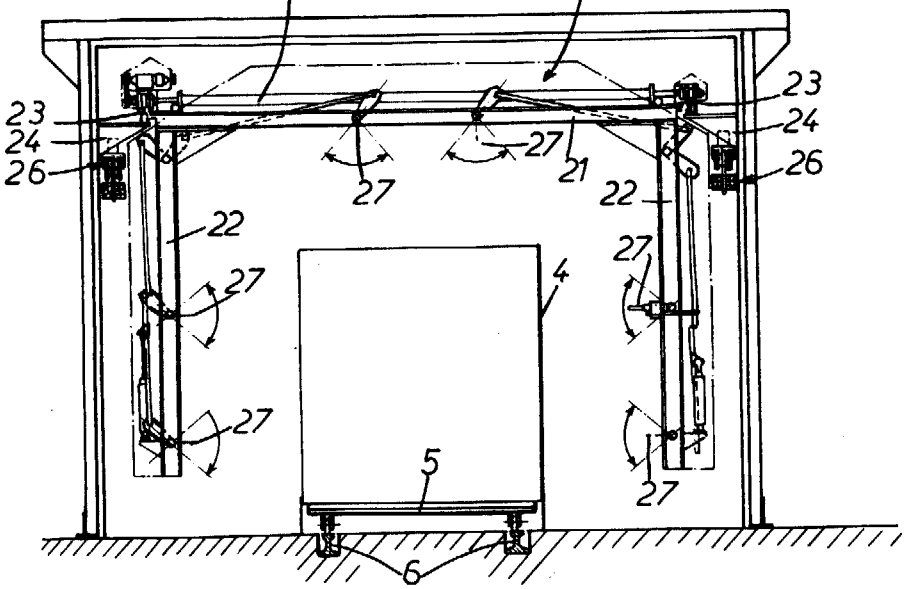
FIG. 2 is a view in section on II—II of FIG. 1 showing the shot-blasting gantry.

The installation illustrated diagrammatically in FIG. 1 comprises a sealed enclosure 1, the ends of which are equipped with entrance and exit doors 2 and 3, respectively, for the parts to be shot-blasted. These parts which, in the example described, consist of substantially parallelepiped containers 4, are placed on a carriage 5 (FIG. 2) displaced on a track 6 traversing the enclosure 1. Inside the enclosure, a shot-blasting gantry 7, shown in three positions A, B, C which will be defined later, is adapted to be displaced along the longitudinal axis of the enclosure in the space comprised between the shot-blasting panel 8 (position A) and the opposite end of the enclosure (position C). This gantry 7, which will be described later, is composed diagrammatically of three ramps, carrying the shot-blasting blast pipes, forming an inverted U, and disposed in a plane perpendicular to the axis of the enclosure.

The panel 8 carries shot-blasting blast pipes and is movable in a direction perpendicular to the longitudinal axis of the enclosure. In order to free the passage for the emergence of the container 4, the panel 8 enters a lateral recess 9 in the enclosure. The detectors 10 to 18 form part of the electrical means for synchronizing the movements of the gantry 7 and of the panel 8.

According to one example of an embodiment of the installation, this invention also comprises an internal shot-blasting device 19 which, when it is not in operation, enters a recess 20 disposed at one side of the enclosure. This device may be used simultaneously or successively with the gantry 7 and/or the panel 8. Electrical synchronization means 65 and 65', control the displacement, the bringing into position and the operation of the device. This device, for example of the type described in the European Patent Application No. 80400301.0 filed in the name of the Applicant on Mar. 4, 1980, consists of an assembly of two carriages of which the first, carrying the second, is displaced longitudinally inside the part, while the second, carrying the shot-blasting blast pipes, is adapted to be displaced perpendicularly to the movement of the first to ensure the treatment of the internal surfaces of the part. The device is brought into position by means permitting its displacement from the recess 20, its positioning in front of the opening in the container 4 and its displacement inside this opening.

Figure 3:
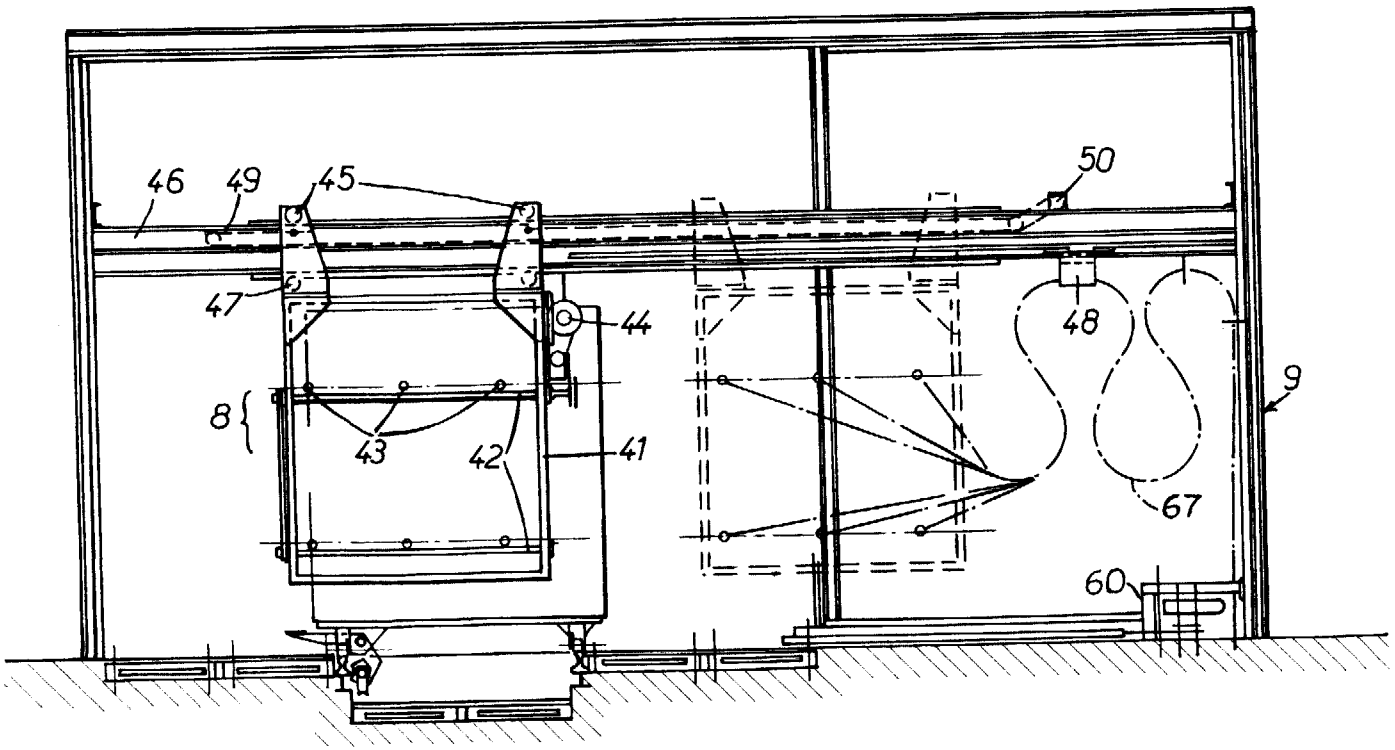
FIG. 3 is a view in section on III—III of FIG. 1 showing the shot-blasting panel.

The installation further comprises means for switching (FIGS. 5 and 6) the mixture of air and shot between the gantry 7 and the panel 8 and possibly other internal or manual shot-blasting devices, and means for controlling (FIG. 3) the movement of the blast pipes of the ramps.

The gantry 7 (FIG. 2) is composed of a small gantry 21 and two caissons 22 (the covering panels have been removed) descending vertically at each side of the container 4 to be treated. The small gantry 21 is displaced by means of four rollers 23 on two rolling tracks 24 fixed to the lateral walls of the enclosure. The displacement of the main gantry 7 is ensured by a motor-reduction-gear—variable transmission—brake unit, disposed in the small gantry 21, driving a shaft 25 controlling a roller on each of the rolling 23 tracks 24. The conduits are supported by carriages 26. The speed of displacement can be regulated, for example, between 0.37 m/min and 2.05 m/min.

Figure 4:
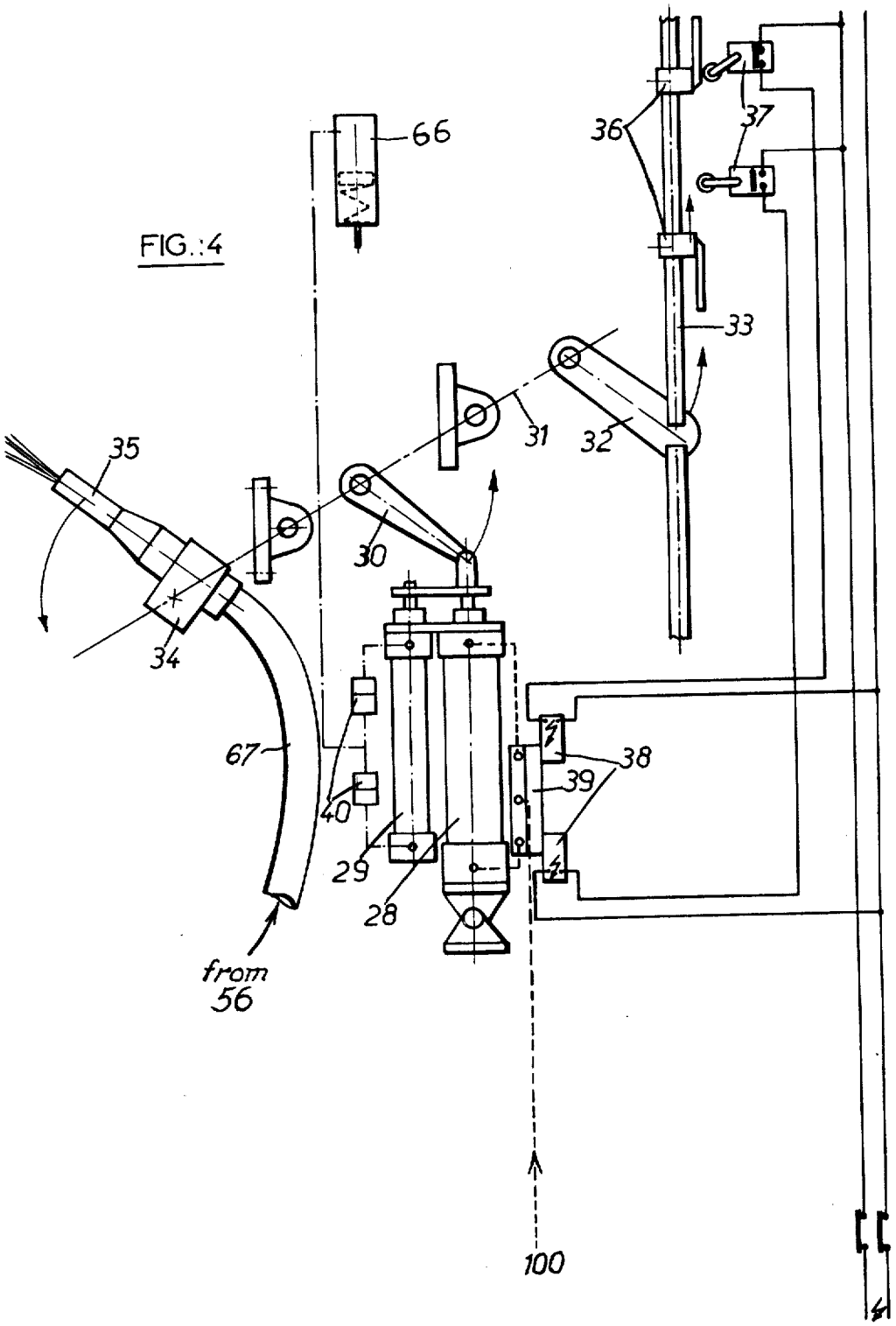
FIG. 4 is a diagrammatic exploded view of the control means for the movement of the blast pipes.

The shot-blasting is ensured by an assembly of blast pipes 27 with a free jet distributed in three ramps disposed facing the three sides of the container 4. According to the example of the embodiment, each ramp carries two oscillating blast pipes 27. The oscillation of the blast pipes 27, known per se, is necessary in order that the shot-blasting jet may sweep the whole of the surfaces to be treated. This oscillation is obtained by a system of rods connecting at least some of the blast pipes 27 to control means which are illustrated diagrammatically in FIG. 4. These means comprise a pneumatic jack 28 with which there is associated a hydraulic shock absorber 29. The rod of the piston of the jack 28 carries a first rod 30 rigidly connected to a spindle 31 controlling a system of a second rod 32 and a third rod 33 actuating the blast-pipe carriers 34. The amplitude of oscillation of the blast pipe nozzle 35 is determined by a contactor device mounted on the rod 33 carried by the adjustable stops 36 and the contacts 37. These contacts 37 control the air feed 100 of electrically operated valves 38 of the distribution slide 39 feeding the jack 28. The speed of displacement of the pneumatic jack 28 can be regulated by acting on the throttle-valves 40 of the oil returns of the hydraulic regulator 66. Corresponding to each speed of displacement of the movable gantry 7 is a speed of translation of the pneumatic jack 28 and the regulation of the two speeds is correct if no wavy line appears on the surface treated.

The panel 8 (FIG. 3) for the shot-blasting of the end is composed of a frame 41 of sectional irons supporting, according to the example of the embodiment, two shafts 42 mounted on bearings to which there are keyed the shot-blasting blast pipes 43 (3 per shaft). At one end of the frame 41 there are control means 44 for the movement of the blast pipes 43, identical in all points to the blast pipes 27 of the movable gantry 7. The frame 41 is supported by two V-shaped rollers 45 running on a beam 46 forming the whole width of the enclosure and extending to the end of the recess 9. The guiding of the frame 41 is ensured by two counter rollers 47, likewise V-shaped, running below the beam 46. In addition to the two V-shaped rollers 45, the beam 46 comprises another lower track (unnumbered) adapted to guide a carriage 48 supporting the flexible pipes 67, the compressed air pipes, the electric cable and, above this, the chain 49 for driving the movable panel 8 in translation. The drive chain 49 is controlled by a motor-reduction-gear—variable-transmission—brake unit 50 situated on the roof of the recess 9.

The switch for the mixture of air and shot (FIGS. 5 and 6) permits the shot-blasting either with the blast pipes 27 of the movable gantry 7, or with the blast pipes 43 of the movable panel 8, or with the blast pipes (not shown) of the internal shot-blasting or manual shot-blasting device 19.

The switch (FIGS. 5 and 6) consists of two plates 51 and 52. According to the form of embodiment intended to feed three different stations by means of three flexible pipes 67 per station, for example, the plate 51, which is fixed, carries at its periphery nine bores distributed in three groups of three (FIG. 5) 53 D, E, F; 54 D, E, F and 55 D, E, F, disposed at 120°. These bores receive sleeves 56 for fixing the flexible pipes 67 feeding the three stations previously mentioned. The plate 52 (FIGS. 5 and 6), which is movable in rotation and in translation, is parallel to the first plate 51. It carries three bores 53, 54, 55 disposed at its periphery at 120° apart. These bores receive sleeves 56 shown in FIG. 6 for fixing the flexible pipes 67 coming from the sand-blasting or shot-blasting machine 60 and form nozzles 57 for the fixed plate 51. The plate 52 is provided in its center with a cylindrical hub 58, adapted to rotate and to slide in a cylindrical body 59, with an axis perpendicular to the plane of the plate 52, rigidly connected to the machine 60 fixed to the base 61, which likewise holds the fixed plate 51. Plates 51 and 52 together constitute switching means arranged on machine 60 which is positioned in the lateral recess 9, as clearly shown in FIGS. 1 and 3. Means of rotation step by step are provided to bring a nozzle of the movable plate 52 in front of one of the nozzles 57 of the fixed plate 51. According to the form of embodiment illustrated, a lug 62, provided at the periphery of the plate 52, receives the end of a piston rod (unnumbered) of a double jack 63, of which the end of the other piston rod is articulated on the base 61. The double-piston jack 63 enables three angular positions of the movable plate 52 to be obtained by rotation about its hub 58. The three positions designated by D, E, F correspond, for example, for the position D, to the feed of the movable gantry 7, for the position E, to the feed of the manual device or internal shot-blasting device 19, and for the position F, to the feed of the movable panel 8. These positions are obtained for D with the two rods (unnumbered in FIG. 5) of the jack 63 moved in; for E, with one rod moved in and one rod moved out and for F with the two rods moved out.

Figure 5:
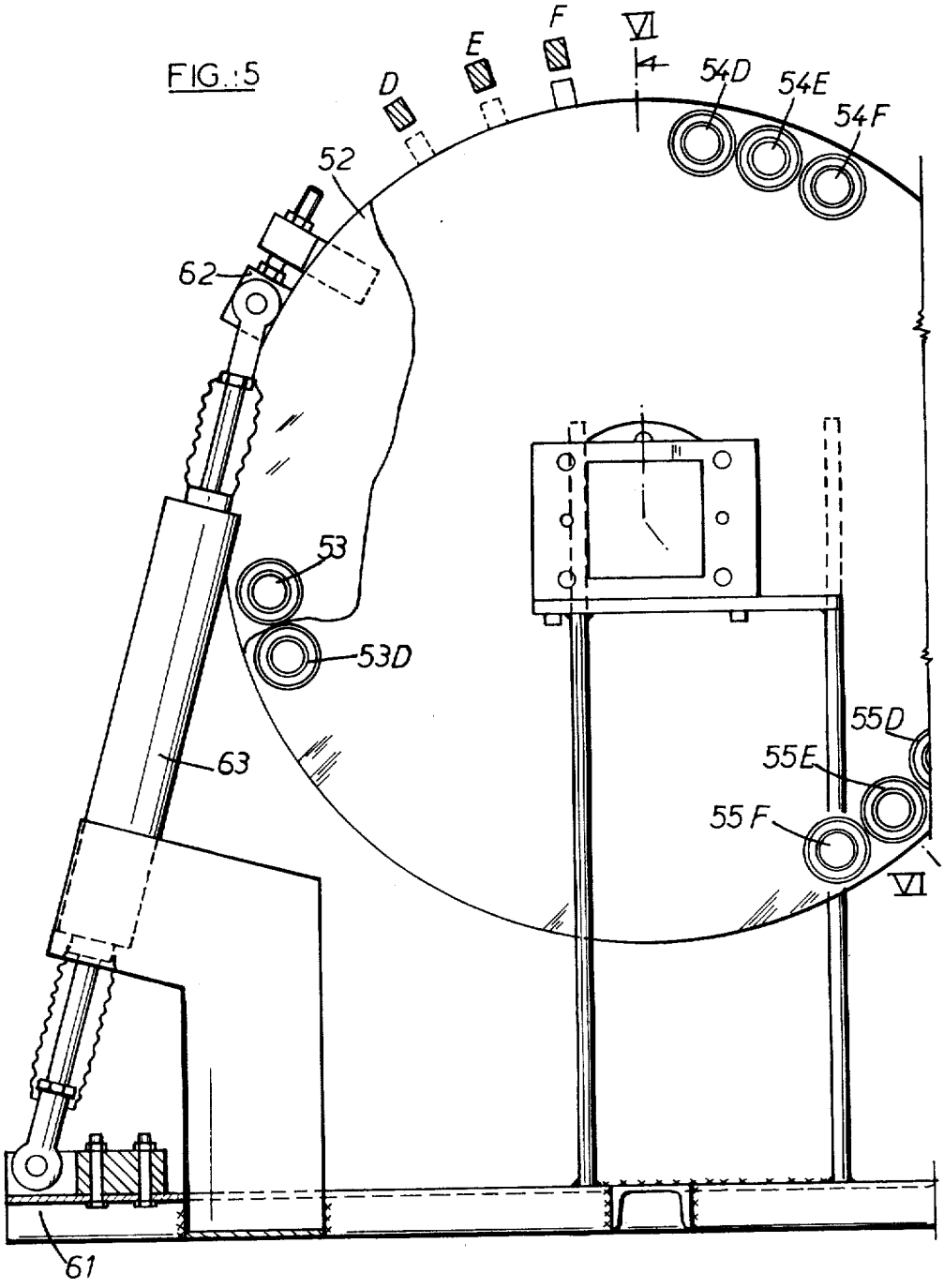
FIG. 5 is a front view, partially broken away, of the means for switching over the mixture of air and shot.
Figure 6:
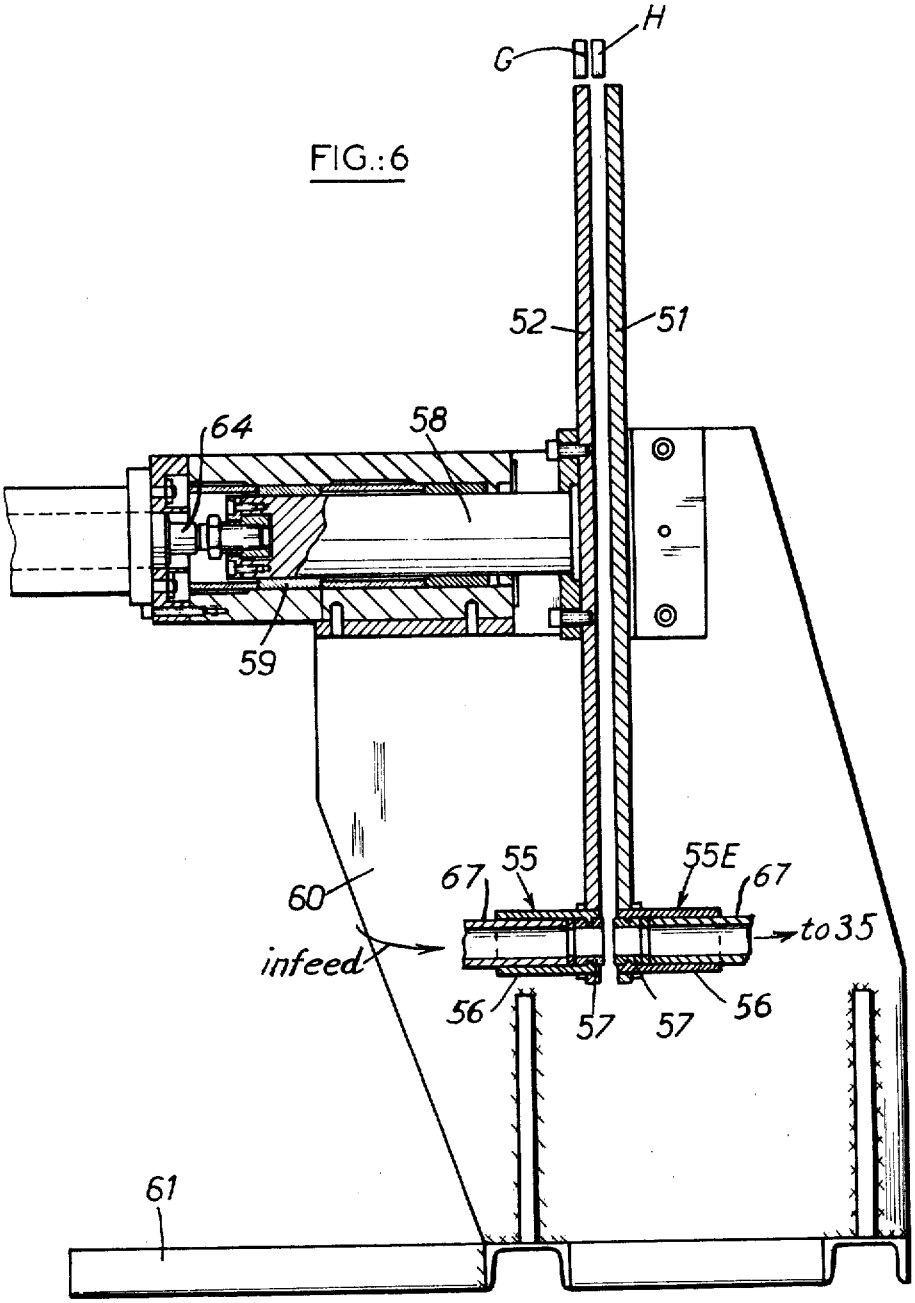
FIG. 6 is a view in section on VI—VI of FIG. 5.

In order to check the position of the rotating plate 52, detectors of rotational position D, E, F and detectors of position G, H close to or far away from the movable plate 52 are provided as illustrated diagrammatically in FIGS. 5 and 6. These positions are obtained by a pneumatic jack of which only the end 64 of a rod (unnumbered) is illustrated in FIG. 6, in order to move the movable plate 52 away from the fixed plate 51 so that the rotation can take place freely, without friction on the seals, or in order to bring plates 51 and 52 together or to bring the seals of the sleeves 56 for fixing the sand-blasting pipes (not shown) into contact.

As FIG. 5 shows, the bores 53, 54 and 55 of the movable plate 52 are adapted to be brought into correspondence with one of the bores 53D, 54D, 55D or 53E, 54E, 55E or 53F, 54F, 55F of the fixed plate 51 to form a sealed passage between the shot-blasting machine and the utilization station or device.

The electrical controls are constructed in such a manner that rotation is possible if the movable plate 52 is at H; the movement of the plate 52 closer to plate 51 is possible if plate 52 is at D, E, F and not between two positions. The shot-blasting is possible if the plate 52 is at G.

The operation of the installation will be described hereinafter (FIG. 1). A simple installation will be assumed without internal shot-blasting but with possible manual shot-blasting.

The gantry 7 is at A on the detector 14, the panel 8 is at K withdrawn into its recess 9. At the detector 18, the air-shot switch of FIG. 5 is in the position E.

The type of container 4 is selected by a switch which, according to the form of the embodiment, permits two positions: I container 12 meters long or J container 6 meters long.

At the beginning of the cycle, the air-shot switch shown in FIG. 5 comes to position D, the shot-blasting begins at the same time as the oscillation of the blast pipes 27 and the translation of the gantry 7. After a delay of a few minutes, the panel 8 is started to reach the position M where it will stop at the detector 16.

If the selection is "container of 12 m" (I), the gantry 7 arrives at the detector 13 and the shot-blasting and the translation of the gantry 7 are stopped for a sufficient time to recharge the shot-blasting machines and the compressed air reservoir. The shot-blasting recommences and, a few seconds after, the translation of the gantry 7 is resumed. When the gantry 7 arrives at the detector 11, the shot-blasting of the roof of container 4 is stopped. When the gantry 7 arrives at the detector 10, the shot-blasting of the sides of container 4 is stopped as well as the translation of gantry 7 and the oscillation of blast pipes 27.

If the selection is "container of 6 m" (J), when the gantry 7 arrives at the detector 13, the shot-blasting of the roof of container 4 is stopped. When gantry 7 arrives at the detector 12, the gantry 7 and the shot-blasting stop.

After the shot-blasting of the sides and the roof of the container 4, the air-shot switch comes into the position F and the shot-blasting, the oscillation of the blast pipes 43, and the translation of the panel 8 begin. Simultaneously, the gantry 7 returns to the position A where it stops at the detector 14.

When the panel 8 passes detector 17 at position L shown in FIG. 1, the shot-blasting stops and the panel 8 stops at the detector 18 in the retracted position inside recess 9. After a delay, the switch shown in FIG. 5 comes into the position E which enables retouching to be done by manual shot-blasting.

The movements in and out of the container 4 are non-automatic operations. Nevertheless, the detectors 15 are safety means controlling the mechanical carriage 5 driving the container 4 and only permitting its movement when the doors 2 and 3 are wide open. Safety means (not shown) for the doors 2 and 3 prevent the operation of the installation if the doors 2 and 3 are not shut.

In an installation comprising an internal shot-blasting device, this operaton could be started simultaneously with the shot-blasting of the sides of container 4 and could, if necessary, continue during the shot-blasting of the end of container 4 by the panel 8. It is then necessary to provide on the air-shot switch extra positions for which the shot feed of the internal shot-blasting device remains permanently connected during the switching over of the feed from the gantry 7 to the panel 8.

By way of example, the shot-blasting of a container 4 of 6 meters is effected in 11 minutes, namely, 9 minutes for the sides and the roof and 2 minutes for the end.

The foregoing preferred embodiment is considered illustrative only. Other modifications will readily occur to those skilled in the art. Consequently, the disclosed invention is not limited to the exact construction shown and described hereinabove but is covered by the claims appended hereinbelow.

I claim:

1. An installation for shot-blasting hollow parts of large dimensions, comprising:

a sealed enclosure, displacement means for the hollow parts to be shot-blasted, a plurality of blast pipes disposed in the enclosure, a shot-blasting panel, movable in a direction perpendicular to the longitudinal axis of the enclosure and retractable in a lateral recess in the enclosure, said panel composed of at least one of said plurality of blast pipes, a shot-blasting gantry, movable in the longitudinal axis of the enclosure, composed of at least one of said plurality of blast pipes, means for switching over an air-shot mixture between at least the gantry and the panel, and means for controlling the movement of the blast pipes composing the shot-blasting gantry.

2. The installation for shot-blasting hollow parts of large dimensions as recited in claim 1, further comprising:

an internal shot-blasting device, positioned at the end of the closure opposite to the end containing the shot-blasting panel, and a lateral recess into which the internal shot-blasting device is retracted.

3. The installation for shot-blasting hollow parts of large dimensions as recited in claim 1, wherein the means for switching the air-shot mixture comprises:

a movable plate and a fixed plate, which are parallel to one another, means for rotating the movable plate, means for translating the movable plate in relation to the fixed plate, said movable plate carrying at least a nozzle connected to one shot-blasting machine, said fixed plate carrying nozzles connected to different shot-blasting stations, said rotating and translating means cooperating to bring the nozzle of the movable plate in front of one of the nozzles of the fixed plate in order to form a sealed passage between said plates.

4. The installation for shot-blasting hollow parts of large dimensions as recited in claim 2, wherein the means for switching the air-shot mixture comprises:

a movable plate and a fixed plate, which are parallel to one another, means for rotating the movable plate, means for translating the movable plate in relation to the fixed plate, said movable plate carrying at least a nozzle connected to one shot-blasting machine, said fixed plate carrying nozzles connected to different shot-blasting stations, said rotating and translating means cooperating to bring the nozzle of the movable plate in front of one of the nozzles of the fixed plate in order to form a sealed passage between said plates.

5. The installation for shot-blasting hollow parts of large dimensions as recited in claim 3, wherein the rotating means includes a jack with two pistons.

6. The installation for shot-blasting hollow parts of large dimensions as recited in claim 4, wherein the rotating means includes a jack with two pistons.

7. The installation for shot-blasting hollow parts of large dimensions as recited in claim 3, wherein the translating means includes a jack.

8. The installation for shot-blasting hollow parts of large dimensions as recited in claim 4, wherein the translating means includes a jack.

9. The installation for shot-blasting hollow parts of large dimensions as recited in claim 5, wherein the translating means includes a jack.

10. The installation for shot-blasting hollow parts of large dimensions as recited in claim 6, wherein the translating means includes a jack.

* * * * *